United States Patent [19]

Anderson et al.

[11] 4,353,215

[45] Oct. 12, 1982

[54] FLUIDIC CONTROL SYSTEM FOR TURBINES

[75] Inventors: Lester M. Anderson, Wellsville, N.Y.; John D. Warnock, Richboro, Pa.

[73] Assignee: Edison International, Inc., Rolling Meadows, Ill.

[21] Appl. No.: 703,173

[22] Filed: Jul. 7, 1976

[51] Int. Cl.[3] ..... F01K 13/02

[52] U.S. Cl. ..... 60/660; 60/662

[58] Field of Search ..... 60/660–667; 415/17

[56] References Cited

U.S. PATENT DOCUMENTS

| | | | |
|---|---|---|---|
| 3,292,648 | 12/1966 | Colston | 415/17 |
| 3,342,195 | 9/1967 | Wagner | 60/662 |
| 3,460,554 | 8/1969 | Johnson | 137/15.2 |
| 3,990,224 | 11/1976 | Kruger | 60/660 |

OTHER PUBLICATIONS

Electronics Engineers Handbook, by D. G. Fink; McGraw-Hill, 1975, pp. 7-65 through 7/68.

Fluidic-Electrical Analogy by Roland Jones, Bowles Engineering Corp., Nov. 1968, pp. 31-32.

*Primary Examiner*—Allen M. Ostrager

*Attorney, Agent, or Firm*—Daniel H. Bobis; Jon Carl Gealow; William H. Wendell

[57] ABSTRACT

A fluidic turbine control system provided to interrelate and control first and second turbine operating conditions, has fluidic computing means operable to proportionally combine fluidic input signals which are representative of the differences, if any, between the actual and desired values of said first and second turbine operating conditions and provide therefrom first and second fluidic control signals for control of said first and second turbine operating conditions. In the preferred form the fluidic turbine control systems as applied to a Steam Turbine and extraction pressure to control turbine operation as a function of the extraction pressure and extraction pressure as a function of the turbine operation.

4 Claims, 4 Drawing Figures

FLUIDIC CONTROL SYSTEM FOR TURBINES

BACKGROUND OF THE INVENTION

1. Field of the Invention

This invention relates to a new and improved fluidic control system for Turbines and, more particularly but not exclusively, to a new and improved fluidic control system for the precisely interrelated control of the speed and extraction (or inlet or exhaust) pressure of a steam turbine which operates in a process environment to drive a process compressor.

2. Description of the Prior Art

Although a variety of turbine control systems are known in the prior art which comprise fluidic components in the nature of pneumatic controllers to provide pneumatic speed and extraction pressure control signals for steam turbine speed and extraction pressure control valve positioning, it may be understood that such systems will generally be found to further comprise pluralities of mechanical linkages, levers and pivots and the like which are operable through mechanical movement to combine the pneumatic valve positioning signals into analog mechanical signals. These mechanical signals are then reconverted into proportional pneumatic valve positioning control signals which operate through appropriate servo mechanisms to position the turbine speed and extraction pressure control valves in accordance with the speed and extraction pressure demands placed on the turbine. The disadvantages of the prior art turbine control systems of this nature are believed well known to include the inherent wear, frictional, lost motion and non-linear characteristics of the mechanical system components which can detract from control system accuracy and which can render precise control system calibration, and/or adjustment to vary control system operational characteristics, difficult and time consuming. Too, the general proximity of the mechanical system components to the turbine can subject the former to heat and vibrational stress, can complicate turbine inspection and maintenance procedures, and can render protective isolation of the control system components more difficult. In addition, the necessity for conversion of pneumatic signals into analog mechanical signals and reconversion of the mechanical signals into pneumatic signals prior to the final signal conversion into mechanical form to operate the turbine control valves can, of course, function to introduce further inaccuracies to prior art control system operation.

SUMMARY OF THE DISCLOSURE

Thus, the present invention covers a fluidic control system for turbines comprising, fluidic input signal generation means and fluidic control signal computing means, respectively, the fluidic input signal generation means include, pneumatic speed and pressure controllers which respectively operate in response to turbine speed and turbine extraction (or inlet or exhaust) pressure indications, and turbine speed and pressure setpoint signals, to provide turbine speed and pressure input signals, the fluidic control signal computing means comprises, a plurality of interrelated pneumatic computing relays operable to compute turbine valve positioning control signals through an appropriately proportioned combination of said speed and pressure input signals, and means are provided to deliver the valve positioning control signals to conventional turbine valve positioning control means to control turbine operation. Control signal limitation means are included in the control signal computing means to insure that the design limits of the turbine are not exceeded by the demands of the control system.

Accordingly, it is an object of this invention to provide an improved fluidic control system for turbines which operates to effect precise turbine control through direct pneumatic control signal computation and application to the turbine operating control means without the use of mechanical linkages, lever, pivots or the like.

Another object of the invention is the provision of a fluidic control system for turbines which may be readily and precisely adjusted to provide for change as desired in the turbine operating conditions being controlled.

Another object of the invention is the provision of a fluidic control system for turbines which may be readily and precisely calibrated.

Another object of the invention is the provision of a fluidic control system for turbines which may be readily and conveniently isolated from the turbine in a protective enclosure of minimal space requirements.

A further object of the invention is the provision of a fluidic control system for turbines which utilizes readily available fluidic components of proven dependability and well understood operational characteristics to thus faciliate system fabrication and provide for long periods of satisfactory, maintenance-free control system operation.

DETAILED DESCRIPTION OF THE INVENTION

1. Configuration of The Fluidic Control System

Figure 1:
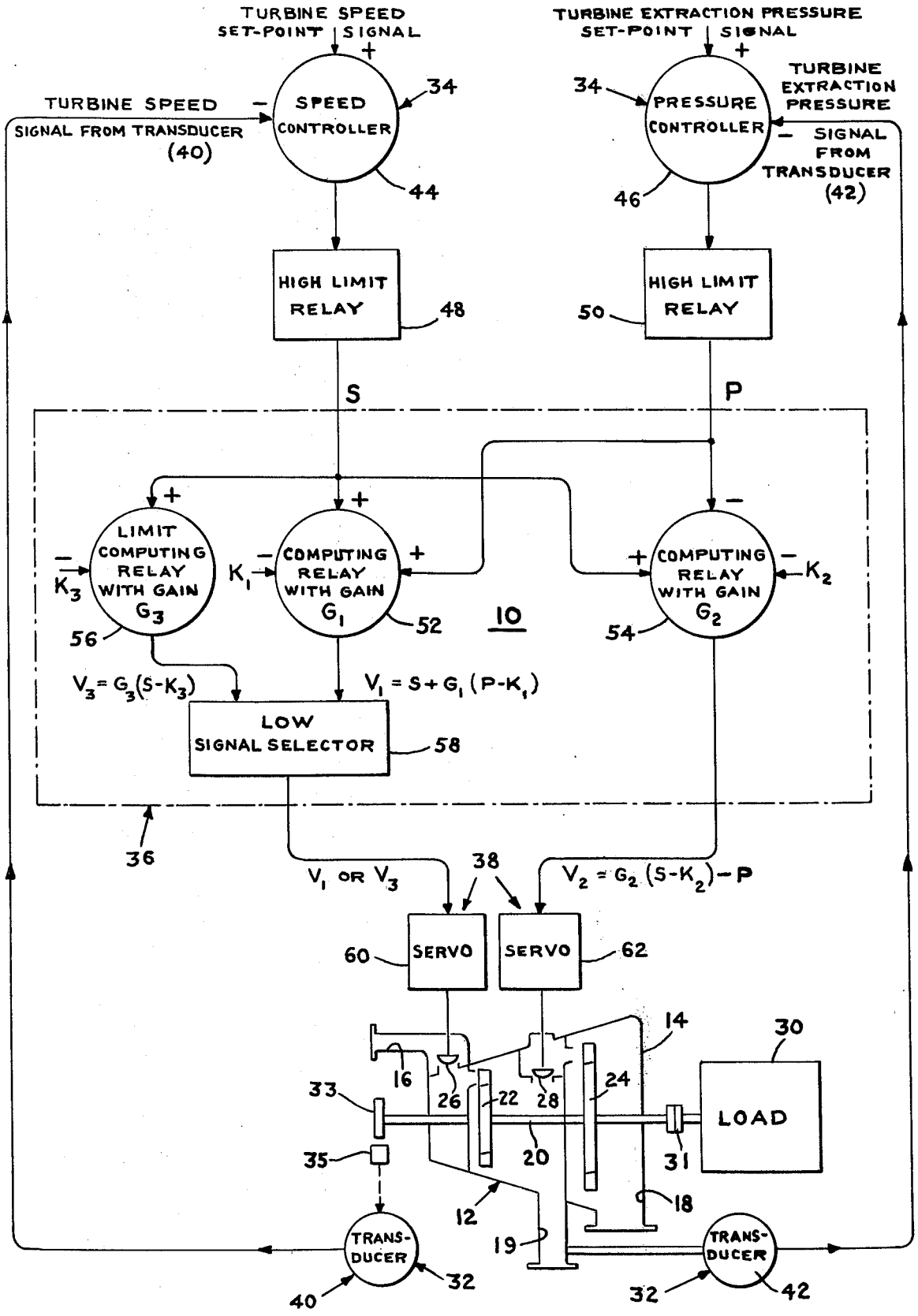
FIG. 1 is a schematic block diagram of a fluidic speed and extraction pressure control system constructed and operative in accordance with the teachings of the invention and depicted in operative relationship with a turbine for control of the speed and extraction pressure thereof.

Referring now to FIG. 1, a fluidic turbine speed and extraction fluid pressure control system constructed and operative in accordance with the teachings of this invention is indicated generally at 10, and may be seen to be depicted in operative relationship with a turbine 12 for control of the latter in accordance with the horsepower and extraction fluid pressure demands placed thereon.

The turbine 12 comprises a casing 14 having a driving fluid inlet conduit 16, a driving fluid exhaust conduit 18, and an extraction fluid exhaust conduit 19. A turbine shaft is indicated at 20, and high and low pressure turbine stages or sections are carried therefrom as respectively indicated at 22 and 24. A high pressure driving fluid inlet control valve is indicated at 26 and an extraction fluid control valve is indicated at 28; it being believed clear that the latter is disposed intermediate the first and second turbine sections and is operable to control the ratio between the amount of driving fluid which is exhausted as extraction fluid from the turbine 12 through conduit 19 intermediate the high and low pressure turbine sections, and the amount of driving fluid which is passed to the low pressure turbine section 24 to add to the horsepower provided by the turbine.

A load is indicated at 30 and the turbine shaft 20 is coupled thereto as shown by coupling 31. A toothed wheel or gear of any suitable ferrous material is indicated at 33 and is disposed on and rotatable with the turbine shaft 20. A magnetic proximity pick-up device which comprises a magnet and coil, is indicated at 35 and is disposed as shown closely adjacent to wheel 33 to detect the rotational speed of the turbine shaft and provide an electrical output signal indicative thereof in response to the inducement of a current in device 35 by rotation of wheel 33.

In a currently preferred application of the fluidic control system 10 of the invention, turbine 12 will take the form of a steam turbine which is utilized in a chemical process to drive a load 30 consisting of a process compressor, while the extraction steam exhausted from conduit 19 will, of course, be put to appropriate process use. It is, however, to be clearly understood that the system 10 is by no means limited to such application, or type of turbine or load, but rather, would be equally applicable to a wide variety of other and different applications, turbines and/or loads.

The fluidic control system 10 operates in response to turbine operating condition detecting means as indicated generally at 32, and comprises fluidic input signal generation means as indicated generally at 34 which are operable to provide appropriate input signals indicative of said turbine operating conditions, and fluidic control signal computing means which are indicated generally at 36 within the dashed lines and which function to proportionally combine said input signals to compute turbine operating control signals. Turbine operating control actuating means are indicated generally at 38 and are operable to control turbine 12 in response to the control signals from the fluidic control signal computing means 36 of the system 10. Although not illustrated, it may be understood that a suitable operating fluid as, for example, instrument air, is provided as required from any suitable source thereof to operate the respective fluidic components of the control system 10.

The turbine operating condition detecting means are respectively operable to detect turbine speed and extraction fluid pressure and, to this effect, comprise and electropneumatic signal transducer 40 which is electrically connected as shown to magnetic pick-up device 35 and functions to convert the electrical signal from the latter into a pneumatic signal indicative of the rotational speed of the turbine shaft 20. An extraction pressure-pneumatic signal transducer is indicated at 42 and is operable as illustrated to detect the extraction pressure in conduit 19 and convert the same to a pneumatic signal indicative of said extraction pressure.

The fluidic input signal generation means comprise a pneumatic speed controller 44, a pneumatic pressure controller 46, and high limit pneumatic relays 48 and 50 which are respectively connected thereto. Applied as shown to speed controller 44 are the pneumatic signal which is indicative of the required speed of turbine 12 and may, for example, in a process application be applied from non-illustrated process controller means. These signals are combined in the manner indicated in controller 44 which produces an output signal "S" which is substantially proportional to the load being carried by the turbine. This pneumatic signal is applied as shown through high limit relay 48 to control signal computing means 36; with relay 48 functioning to limit the load placed on turbine 12 by limiting the magnitude of the pneumatic signal which will be transmitted to a predetermined maximum. Applied as shown to pressure controller 46 are the pneumatic signal from transducer 42, and an extraction pressure set-point signal which is indicative of the required extraction pressure. These signals are combined in the manner indicated in controller 46 to provide a pneumatic signal "P" which is substantially proportional to the flow of extraction steam from the turbine. This latter signal is applied as shown through high limit relay 50 to control signal computing means 36; with relay 50 functioning to limit the extraction flow demands placed on turbine 12 by limiting the magnitude of the pneumatic signal which will be transmitted to a predetermined maximum.

The control signal computing means 36 comprise pneumatic computing relays 52 and 54, to each of which the pneumatic signals from speed controller 44 and pressure controller 46 are applied as indicated, a limiting pneumatic computing relay 56 to which only the pneumatic signal from speed controller 44 is applied, and a pnuematic low signal selector 58 to which the pneumatic control signals from computing relays 52 and 56 are applied as indicated for further limiting the extraction flow demands placed on turbine 12 as described in greater detail hereinbelow.

The turbine operating control actuating means 38 comprise a pneumatic-hydraulic servo 60 which is connected as shown to turbine driving fluid inlet control valve 26 and is operable to control the position thereof, and a pneumatic-hydraulic servo 62 which is connected as shown to the turbine extraction fluid control valve 28 and is operable to control the position thereof; and it may be understood that, briefly described, they compute, by summation and multiplication, an output pneumatic valve control positioning signals $V_1$, $V_2$ and $V_3$ which are respectively applied as shown to the servos 60 and 62 to control turbine valve positioning.

Figure 3:
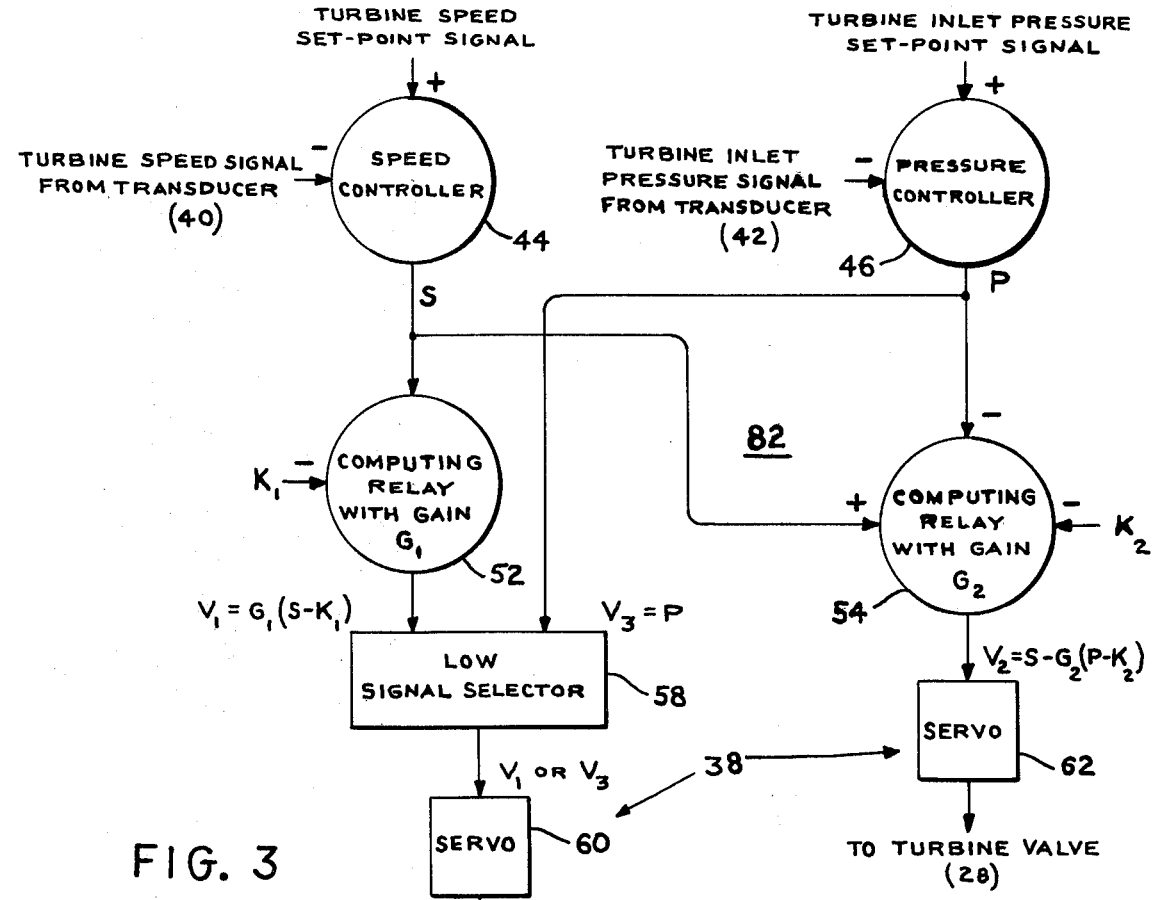
FIG. 3 is a schematic block diagram of a second embodiment of the control system of the invention wherein turbine speed and inlet pressure are controlled.

An embodiment of the fluidic control system of the invention which functions to control turbine speed and inlet pressure, rather than speed and extraction pressure, is indicated generally at 82 in FIG. 3 and may readily be seen to differ from the embodiment of FIG. 1 in that the limiting pneumatic relay 56 is eliminated and the signal P from the pressure controller 46 is applied directly as $V_3$ to the low signal selector 58. In addition, and although not again illustrated, it may be understood that transducer 42 functions in this embodiment as a turbine inlet pressure-pneumatic signal transducer and would thus be arranged to detect turbine inlet pressure in turbine inlet conduit 16 rather than extraction pressure in extraction conduit 19.

An embodiment of the fluidic control system of the invention which functions to control turbine speed and exhaust pressure, rather than speed and extraction pressure, is indicated generally at 84 in FIG. 4 and may again be readily seen to differ from the embodiment of FIG. 1 in that the pneumatic computing relay 54 is eliminated, the signal P from pressure controller 46 is applied directly as $V_2$ to the servo 62, and low signal selector 58 is replaced by a high signal selector 86. In addition, and although not again illustrated, it may be understood that transducer 42 functions in this embodiment as a turbine exhaust pressure-pneumatic signal transducer and would thus be arranged to detect turbine exhaust pressure in exhaust conduit 18 rather than extraction pressure in extraction conduit 19.

2. Operating Equations For The Fluidic Control System

The operating equations for the pneumatic computing relays 52, 54 and 56 of the embodiment of FIG. 1 are as follows:

$$V_1=S+G_1(P-K_1)$$

$$V_2=G_2(S-K_2)-P$$

$$V_3=G_3(S-K_3)$$

wherein:

S is the signal from speed controller 44,
P is the signal from pressure controller 46,
$G_1$ is the gain of computing relay 52,
$G_2$ is the gain of computing relay 54,
$G_3$ is the gain of computing relay 56, and
$K_1$, $K_2$, and $K_3$ are fixed biasing pressures, the respective values of which are selected to keep the magnitudes of the control signals within the operational ranges of standard pneumatic components.

The operating equations for the pneumatic computing relays 52 and 54 of the embodiment of FIG. 3 are as follows:

$$V_1=G_1(S-K_1)$$

$$V_2=S-G_2(P-K_2)$$

$$V_3=P$$

Figure 4:
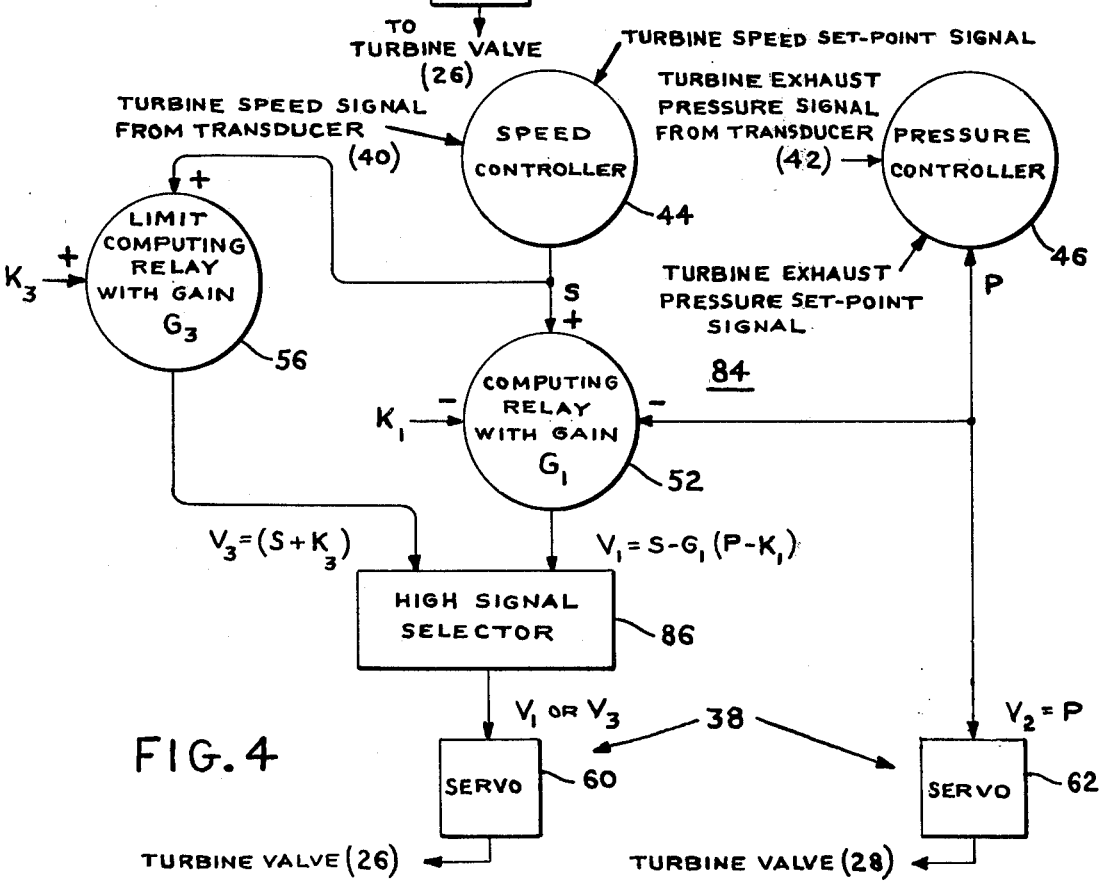
FIG. 4 is a schematic block diagram of a third embodiment of the invention wherein turbine speed and exhaust pressure are controlled.

The operating equations for the pneumatic computing relays 52 and 56 of the embodiment of FIG. 4 are as follows:

$$V_1=S-G_1(P-K_1)$$

$$V_2=P$$

$$V_3=G_3(S+K_3)$$

3. Calculation of Gain Values

Figure 2:
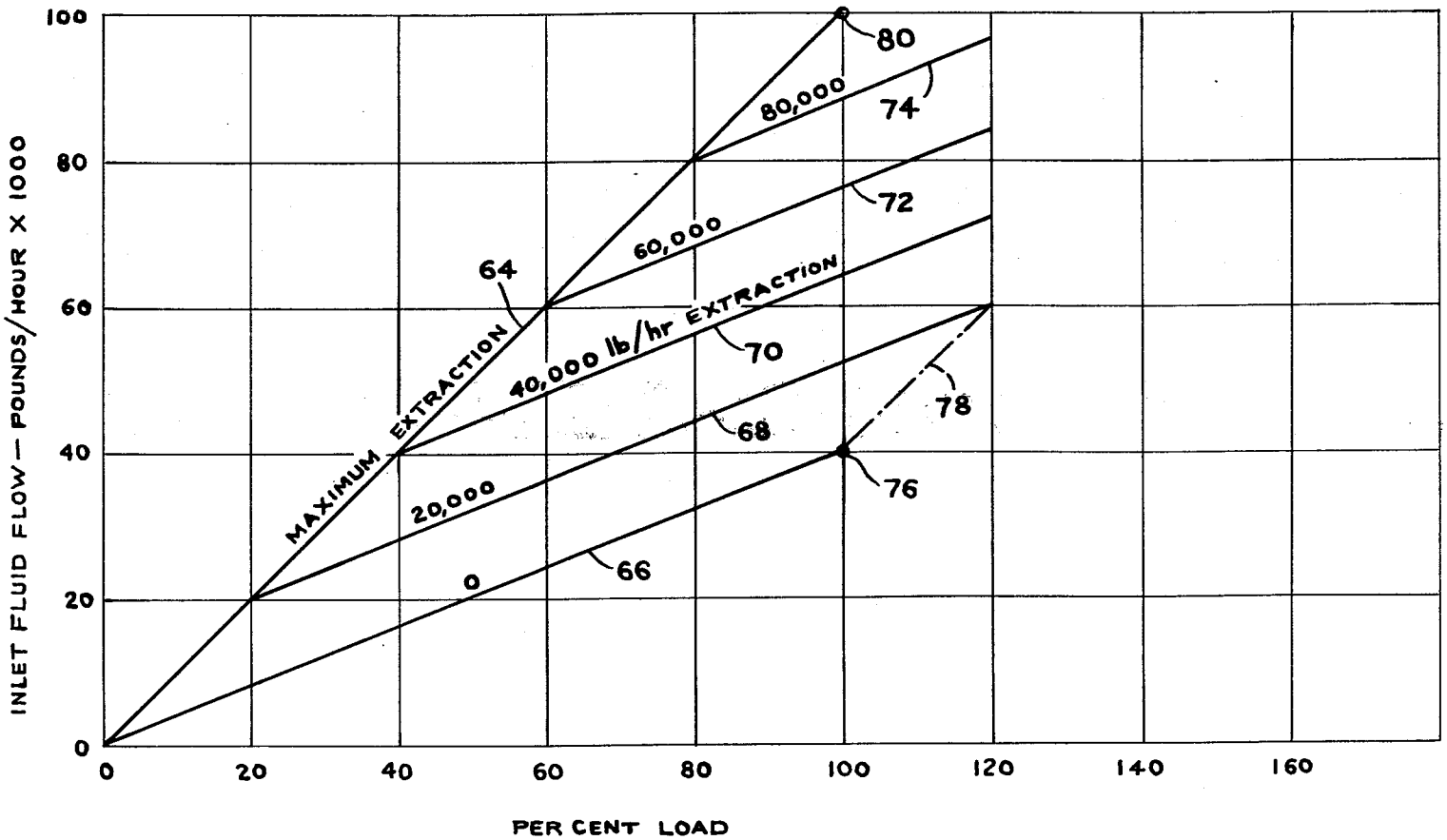
FIG. 2 is a graph of turbine fluid inlet flow plotted against turbine load.

The gain values $G_1$ and $G_2$ for the computing relays 52 and 54 are calculated from typical extraction turbine performance curves as depicted in FIG. 2 wherein turbine driving fluid inlet flow is plotted against turbine load at maximum extraction fluid flow as indicated by curve 64, and at extraction fluid flow rates of the indicated magnitudes as represented by curves 66, 68, 70, 72 and 74. Thus, if the required inlet and extraction control valve actions are considered for purposes of calculating the required gain $G_1$ as the turbine is brought, for example, from rest to 100% load with a driving fluid inlet flow of 40,000 pounds per hour and zero extraction fluid flow as represented by point 76 and curve 66, it may be readily understood that the inlet valve 26 will have been opened to 40% of flow capacity (since 40,000 pounds per hour of driving fluid is 40% of the maximum available 100,000 pounds per hour), while the extraction valve 28 will have been fully opened to 100% of flow capacity to, under the prescribed zero extraction fluid flow condition, pass the entire 40,000 pounds per hour of driving fluid to the low pressure turbine section 24. That this is the maximum amount of driving fluid which can be passed by valve 28 to turbine section 24 under the prescribed conditions is clearly indicated by the dashed line curve 78 in FIG. 2 Since this action is bringing turbine 12 from zero to 100% load will occur in response to a demand from speed controller which results from increase in the speed set-point pneumatic signal applied thereto, the required speed control signal gain of computing relay 52 may readily be calculated as follows:

$$G_2=\Delta V_2/\Delta V_1=100/40=2.5$$

In like manner, if the required valve actions are considered for purposes of calculating the required gain $G_2$ as the extraction flow rate demand is increased from zero to a maximum of 100,000 pounds per hour in response to increase in the extraction pressure set-point signal which is applied to pressure controller 46, with no change in load on the turbine 12 as represented in FIG. 2 by moving from point 76 on curve 66 to point 80 on curve 64, it may again be readily understood that inlet valve 26 will have moved to the fully or 100% open position to pass the maximum 100,000 pounds per hour of driving fluid while extraction valve 28 will have moved to the fully closed position to result in the extraction of the entire 100,000 pounds per hour of driving fluid through conduit 18. Thus, the inlet valve 26 will have moved through 60% of its range of travel from the 40% open position thereof at point 76 to the 100% open position thereof at point 80, while the extraction valve 28 will have moved through 100% of its range of travel to render the pressure control signal gain of computing relay 54 calculable as follows:

$$G_1=\Delta V_1/\Delta V_2=60/100=0.6$$

The necessity that the inlet valve 26 and the extraction valve 28 move in opposite directions during changes in extraction flow demand is met by applying the pressure signal P from controller 46 to computing relay 54 in the negative direction as clearly indicated in FIG. 1.

The gain value for the limiting computing relay 56 is calculated in the same manner as is the gain value for computing relay 52, subject to the extraction flow demand limitation function of relay 56 as described in detail hereinbelow.

4. Examples Of Fluidic Control System Operation

With turbine 12 operating under control of the fluidic control system embodiment of FIG. 1 to meet predetermined power and extraction flow demands, it may be understood that an increase in power demand without change in extraction flow demand will result, through decrease in the speed of the turbine and corresponding decrease in the signal which is applied from transducer 40 to speed controller 44, an increase in the output signal S which is applied from controller 44 to computing relay 52, and corresponding increase in the control signal $V_1$ which is applied from relay 52 to servo 60. This in turn results in increased opening of the turbine inlet valve 26 by servo 60 to admit the required increased amount of driving fluid. However, in order to insure that extraction pressure, and thus flow, is not changed since there is no change in the demand therefor, the increased signal S is concomitantly applied as shown to computing relay 54 to result in increase in the control signal $V_2$ which is applied therefrom to servo 62 and attendant increased opening of the extraction valve 28 to pass the increase in driving fluid through to turbine section 24 and out turbine exhaust 18 and thus maintain extraction pressure and flow unchanged. The increase in the control signal $V_2$, and thus the relative extent to which the opening of the extraction valve 28 is increased are, of course, determined in large measure by the gain value $G_2$ of the computing relay 54 as based upon the relative fluid flow capacities of the inlet and extraction valves and the relative power generation capabilities of the respective turbine sections controlled thereby.

With turbine 12 again operating under control of the fluidic control system embodiment of FIG. 1 as above, it may be understood that an increase in extraction flow demand without change in power demand will result, through decrease in the pressure in extraction fluid conduit 19 and corresponding decrease in the signal which is applied from transducer 42 to pressure controller 46, in increase in the output signal P which is applied from controller 46 to computing relay 52, and corresponding increase in the control signal $V_1$. This again results in increased opening of the inlet valve 26 to admit the required increased amount of driving fluid. The concomitant application of this increased output signal P in the negative direction to computing relay 54 is, however, effective to reduce control signal $V_2$ with attendant movement of the extraction valve 28 in the closing direction to a position which will both meet the demand for increased extraction flow while, at the same time, not increase the speed or, as follows, the total power output, of the turbine 12 by directing too much driving fluid to the low pressure turbine section 24. Thus, the speed signal from transducer 40 to speed controller 44 remains substantially constant during this control function, while the respective extents of the movements of turbine valves 26 and 28 will again be determined in large measure by the respective gain values of the computing relays 52 and 54.

In each of the above examples, the high limit relays 48 and 50 may be set at respective, predetermined maximum speed and pressure signal levels to limit the power and extraction flow demands which can be made on the turbine 12 in accordance with said levels.

Additional, and more coordinated, limitation on the speed and extraction flow demands made on turbine 12 by the fluidic control system embodiment of FIG. 1, which demands may exceed turbine design limits, is provided by the computing relay 56 and low signal selector 58. More specifically, and considering for example a situation wherein extraction fluid demand is high while turbine power demand is low, it may be understood that even with a fully closed extraction valve 28, the extraction flow demand could only be met if the driving fluid flow through the high pressure turbine section 22 was in excess of that required to produce the power demanded. The design limit of the turbine regarding extraction flow demand is represented by curve 64 in FIG. 2 and it may be understood that, at this limit, demands for extraction flow must yield to demands or limitations from the speed controller 44. In other words, if the design limits of the turbine 12 do not allow sufficient extraction flow to satisfy the demands of the pressure controller 46 at a particular setting of the speed controller 44, the demands of the former must be superseded so as not to interfere with the operation of the latter. It is to this effect that computing relay 56 functions in response to the application thereto as indicated of the speed signal S to continually compute an alternative speed control signal $V_3$ (in reality the slope of curve 64) which represents the maximum extraction flow demand that can be met by turbine 12 at a particular load demand. In any instance wherein $V_3$ becomes less than $V_1$, the former is selected by low signal selector 58 and applied as indicated to the servo 60 to control the inlet valve 26 and thus effectively override the action of pressure controller 46 and computing relay 52 and prevent the application of a speed control signal $V_1$ to servo 60 to meet extraction flow demands which exceed the design limit of the turbine 12 at the load then being carried.

Referring now to the operation of the system embodiment 82 of FIG. 3, it may be understood that the turbine extraction pressure is there maintained by means not associated with the turbine rather than by extraction control valve 28, and the amount of fluid extracted is determined in accordance with only the speed and inlet pressure signals S and P provided by the speed and inlet pressure controllers 44 and 46. More specifically, speed controller 44 provides the speed signal S to computing relay 52 for computation of $V_1$ and application to low signal selector 58 to maintain turbine speed at the set-point value, while the inlet pressure signal P is here applied directly as $V_3$ to signal selector 58 to maintain the turbine inlet pressue at the set-point valve. The computing relay 54 of course computes $V_2$ through appropriate combination of S and P as indicated. Again, the depicted interconnections between the controllers 44 and 46, and computing relays 52 and 54 insure that a control signal to modify turbine speed will not upset turbine inlet pressure and vice versa. The low signal selector 58 functions in the embodiment of FIG. 3 to enable the speed control signal $V_1$ to override the inlet pressure control signal $V_3$ when the latter would result in the opening of turbine inlet valve 26 to an extent greater than that required by the power demanded from turbine 12.

The operation of the embodiment 84 of FIG. 4 again involves the maintenance of the turbine extraction pressure by means not associated with the turbine, with the extraction flow there being determined by turbine speed and turbine exhaust pressure. In this embodiment the controlled parameters are turbine speed and turbine exhaust pressure, and the exhaust pressure signal P from controller 46 is applied directly as $V_2$ to control the extraction valve 28, while the control signals $V_1$ and $V_3$ for the turbine inlet valve 26 are computed by computing relays 52 and 56 in the same manner as described hereinabove with regard to the embodiment of FIG. 1. High signal selector 86 here functions to limit the action of the exhaust pressure controller 46 when the maximum capability of the turbine 12 to provide exhaust fluid has been reached.

Although turbine inlet valve 26 and turbine extraction valve 28 are referred to as singular in each of the above examples, it will be clear to those skilled in this art that, in actual practice, the said "valve" will be constituted by a plurality of valves.

5. Control System Disposition, Maintenance, Calibration and Adjustment

Since the control system of the invention is separate and distinct from the turbine 12 and requires only the two fluidic lines from the transducers 40 and 42, and the two fluidic lines to the servos 60 and 62 for operable connection to the turbine, it is believed clear that the control system may be conveniently disposed remotely of the turbine 12, as for example in an appropriate, tamper-proof protective container, to thus simplify inspection and maintenance to the turbine and, in essence, keep the control system out of harm's way.

Regarding maintenance, the fact that only standard fluidic components of proven reliability which are not subject to wear in the manner of the mechanical components of prior art systems are utilized in the control system of the invention should both reduce maintenance needs and render that maintenance which is required more readily accomplishable by competent instrument technicians.

Calibration of the system of the invention may readily be accomplished in relatively short order by minor set screw adjustments to the standard fluidic system components utilized therein.

Adjustment of the control system of the invention to change turbine operating conditions, by change in the turbine valve positioning ratios controlled by the system, may be readily accomplished by appropriate adjustment in the gains of the included computing relays.

Various changes may of course be made in the disclosed embodiments of the invention without departing from the spirit thereof as defined in the appended claims.

What is claimed is:

1. The combination in a pneumatic pressure type fluidic control system for the interrelated control of first and second operating conditions of a steam turbine in accordance with predetermined desired values therefore of, a. said steam turbine has, a steam inlet valve, a steam extraction conduit for the extraction of steam from an intermediate stage of said steam turbine, and a steam extraction valve in said steam extraction conduit to control the flow of steam extracted from said intermediate stage of the steam turbine, b. said steam inlet valve to control the speed of the steam turbine as the first operating condition to be interrelated and controlled and said steam extraction valve to control the pressure of the steam extracted from said steam turbine as the second operating condition to be interrelated and controlled relative the steam utilized to maintain the desired speed of the steam turbine, c. fluidic means responsive to signals of the actual values of said first and said second operating condition and to settings of the predetermined desired values of said conditions to provide first and second fluidic input signals representative of the differences, if any, therebetween, d. fluidic computing means including, 1. first and second interconnected fluidic computing relays, 2. means operatively interrelated in said first and second computing relays to proportionately combine said first and second fluidic input signals to provide first and second fluidic control signals in accordance with the following equations:

$$V_1=S+G_1(P-K_1)$$

$$V_2=G_2(S-K_2)-P$$

wherein $V_1$ is the first fluidic control signal which controls, the position of the steam inlet valve, $V_2$ is the second fluidic control signal which controls the position of the steam extraction valve, S is the first fluidic input signal which is substantially proportional to the load on the turbine, P is the second fluidic input signal which is substantially proportional to steam flow in the steam extraction conduit, $G_1$ is the fluidic gain of the first fluidic computing relay, $G_2$ is the fluidic gain of the second fluidic computing relay, and $K_1$ and $K_2$ are fluidic biasing signals which are respectively applied to said first and second fluidic computing relays, e. a fluidic limit relay operatively connected to said means to modify said fluidic input signal S to provide a third fluidic control signal in accordance with the following equation $$V_3=G_3(S-K_3)$$

wherein $V_3$ is the third fluidic input signal, $G_3$ is the fluid gain of the fluidic limit computing relay, and $K_3$ is a fluidic biasing signal which is applied to said fluidic limit computing relay, and f. low signal selector means to receive said fluidic control signals $V_1$ and $V_3$ and operable to select the lower of said $V_1$ and $V_3$ signals and to transmit control signals for control of the position of said steam inlet valve to regulate the steam delivered to the steam inlet valve for said steam turbine.

2. The combination in a pneumatic pressure type fluidic control system for the interrelated control of first and second operating conditions of a steam turbine in accordance with predetermined desired valves therefore of;

a. said steam turbine has, a steam inlet valve, a steam extraction conduit for the extraction of steam from an intermediate stage of said steam turbine, and a steam extraction valve in said steam extraction conduit to control the flow of steam extracted from said intermediate stage of the steam turbine, b. said steam inlet valve to control the speed of the steam turbine as the first operating condition to be interrelated and controlled and said steam extraction valve to control the pressure of the steam extracted from the intermediate stage of said steam turbine as the second operating condition to be interrelated and controlled relative the steam utilized to maintain the desired speed of the steam turbine, c. fluidic means responsive to signals of the actual values of said first and said second operating conditions and to settings of the predetermined desired values of said conditions to provide first and second fluidic input signals representative of the differences, if any, therebetween, d. fluidic computing means including, first and second interconnected fluidic computing relays, e. means to apply said first and second fluidic input signals to said first and second computing relays for proportional combination thereof, f. said first fluidic computing relay operable to modify said first fluidic input signal and said second fluidic computing relay operable to proportionally combine said first and second fluidic input signals to provide fluidic control signals in accordance with the following equations $$V_1=G_1(S-K_1)$$

$$V_2=S-G_2(P-K_2)$$

wherein;

$V_1$ is the first fluidic control signal which controls the position of the steam inlet valve, $V_2$ is the second fluidic control signal which controls the position of the steam extraction valve, S is the first fluidic input signal which is substantially proportional to the load on the turbine, P is the second fluidic input signal which is substantially proportional to steam flow in the steam extraction conduit, $G_1$ is the fluidic gain of the first fluidic computing relay, $G_2$ is the fluidic gain of the second fluidic omputing relay, and $K_1$ and $K_2$ are fluidic biasing signals which are respectively applied to said first and second fluidic computing relays, and g. means operatively connected to the steam extraction conduit to provide a third fluidic control signal in accordance with the following equation:

$$V_3=P$$

wherein $V_3$ is a third fluidic control signal substantially proportional to steam flow in the steam extraction conduit h. and, low signal selector means being operable to select the lower of said $V_1$ and $V_3$ fluid control input signals and to transmit the selected one to said steam inlet valve.

3. The combination in a pneumatic pressure type fluidic control system for the interrelated control of first and second operating conditions of a steam turbine in accordance with predetermined desired valves therefor of;

a. said steam turbine has, a steam inlet valve, a steam extraction conduit for the extraction of steam from an intermediate stage of said steam turbine, and a steam extraction valve in said steam extraction conduit to control the flow of steam extracted from said intermediate stage of the steam turbine, b. said steam inlet valve to control the speed of the steam turbine as the first operating condition to be interrelated and controlled and said steam extraction valve to control the pressure of the steam extracted from the intermediate stage of said steam turbine as the second operating condition to be interrelated and controlled relative the steam utilized to maintain the desired speed of the steam turbine, c. fluidic means responsive to signals of the actual values of said first and said second operating condition and to settings of the predetermined desired values of said conditions to provide first and second fluidic input signals representative of the differences, if any, therebetween, d. fluidic computing means including, 1. a first computing relay, 2. means operatively interrelated in said first computing relay to proportionately combine said first and second fluidic input signals to provide a first fluidic control signal in accordance with the following equations:

$$V_1=S-G_1(P-K_1)$$

wherein, $V_1$ is the first fluidic control signal which controls the position of the steam inlet valve, S is the first fluidic input signal which is substantially proportional to the load on the turbine, P is the second fluidic input signal which is substantially proportional to steam flow in the steam extraction conduit, $G_1$ is the fluidic gain of the first fluidic computing relay, and $K_1$ is the fluidic baising signal which is applied to said first fluidic computing relays;

and a second fluidic control signal in accordance with the following equation:

$$V_2=P$$

wherein:

$V_2$ is the second fluidic control signal which controls the position of the steam extraction valve.

e. a second fluidic computing relay connected and operable to modify said first fluidic input signal to provide a third fluidic control signal in accordance with the equation $$V_3=(S-K_3)$$

wherein $V_3$ is the third control signal $K_3$ is a fluidic biasing signal which is applied to said second fluidic computing relay f. and, fluidic transmitting means connected between said fluidic computing means and said steam inlet valve and said steam extraction valve to selectively apply fluidic control signals $V_1$ and $V_3$ for controlling said first operating condition of the turbine and fluidic control signal $V_2$ to said steam extraction valve for controlling said second operating condition of the turbine.

4. In the combination for a fluidic control system as claimed in claim 3 wherein said fluidic transmitting means includes, high signal selector means operable to receive said control signals $V_1$ and $V_3$ and to select the higher of said $V_1$ and $V_3$ signals for application to said steam inlet valve.

* * * * *